US005303914A

United States Patent [19]

Cooksey

[11] Patent Number: 5,303,914

[45] Date of Patent: Apr. 19, 1994

[54] TRIPLE-ADJUSTABLE HEIGHT BATTING PRACTICE DEVICE

[75] Inventor: Dennis W. Cooksey, Houston, Tex.

[73] Assignee: James N. Cooksey, Houston, Tex. ; a part interest

[21] Appl. No.: 89,099

[22] Filed: Jul. 12, 1993

[51] Int. Cl.[5] ..... A63B 69/40

[52] U.S. Cl. ..... 273/26 E

[58] Field of Search ..... 273/26 R, 29 A, 26 D

[56] References Cited

U.S. PATENT DOCUMENTS

| | | | |
|---|---|---|---|
| 2,443,131 | 6/1948 | Fessler | 273/26 R |
| 3,529,823 | 9/1970 | Garver | 273/26 |
| 3,547,437 | 12/1970 | Andersen | 273/26 |
| 3,663,018 | 5/1972 | O'Leary | 273/26 A |
| 4,907,801 | 3/1990 | Kopp | 273/26 R |
| 5,046,476 | 9/1991 | Nozato | 273/26 D |
| 5,071,122 | 12/1991 | Messina | 273/26 R |
| 5,226,645 | 7/1993 | Stewart | 273/26 R |
| 5,228,684 | 7/1993 | Levatino | 273/26 R |

*Primary Examiner*—Theatrice Brown

*Attorney, Agent, or Firm*—Jacobson, Price, Holman & Stern

[57] ABSTRACT

An upright standard is provided including a plurality of horizontally outwardly projecting vertically spaced support arms journaled from the sleeve for rotation thereabout, the outer ends of the support arms including target members thereon for striking by a bat-like member. The upright is removably supported from a base structure including depending ground impaling blades and the support arms are mounted from the upright upon sleeves journaled from the upright and including weight means on the sides thereof opposite the sides from which the support arms project in order to enable the support arms to rotate about the upright in a substantially balanced manner.

10 Claims, 1 Drawing Sheet

TRIPLE-ADJUSTABLE HEIGHT BATTING PRACTICE DEVICE

BACKGROUND OF THE INVENTION

1. Field of the Invention

This invention relates to a batting practice device, primarily for children, which enables children of different sizes to engage in batting practice and also which enables a child of a given height to engage in batting practice at three different heights.

2. Description of Related Art

Various different forms of batting practice devices heretofore have been provided including some of the general, structural and operational features of the instant invention. Examples of these previously known forms of batting practice devices are disclosed in U.S. Pat. Nos. 3,529,823, 3,547,437, 3,663,018, 4,907,801 and 5,071,112. However, these previously known forms of batting practice devices do not include the overall combination of structural and operational features of the instant invention.

SUMMARY OF THE INVENTION

The batting practice device incorporates an upright standard whose lower end is removably supported from a base structure adapted for support from a horizontal surface and which is further adapted to maintain the upright supported therefrom in an upright position against considerable lateral force directed thereon. A plurality of vertically spaced horizontally outwardly projecting support arms have their base ends journaled from the upright and target members such as baseballs are supported from the free ends of the arms to be struck at by children swinging a bat.

The support arms are journaled from the upright through the utilization of sleeves which are counterweighted on the sides thereof remote from the sides from which the arms project in order that the arms may swing about the upright in reasonably balanced condition and the upright is removably supported from the base through the utilization of a bayonet connection, whereby the batting practice may be compactly stored. In addition, the sleeves which journal the support arms from the upright each are loosely received between a pair of upper and lower abutment rings mounted upon the upright and each pair of upper and lower support rings is adjustable along the vertical extent of the upright. In this manner, the batting practice device may be readily modified for use by different height children.

The main object of this invention is to provide a batting practice device which may be used effectively to teach small children the art of baseball or softball batting.

Another object of this invention is to provide a batting practice device which will enable a child of a given size to quickly alternately practice between batting a high ball, a low ball or a midheight ball.

Still another important object of this invention is to provide a batting practice device in accordance with the preceding objects which may be adjusted to accommodate children of different heights.

A further object of this invention is to provide a batting practice device constructed in a manner such that it may be broken down for compact storage and transport.

A further object of this invention is to provide a batting practice device including a base structure for support of the batting practice from the ground and wherein the batting practice device includes ground penetrating tines.

Yet another object of this invention is to provide a batting practice device including horizontally outwardly projecting arms rotatably supported from an upright and wherein the arms are counterbalanced with sufficient weighting whereby the arms may rotate about the upright in reasonably balanced relation and whereby the arms will have sufficient momentum, when swung in the opposite direction towards a practicing batter, to simulate movement of the target ball toward the strike zone of the batter.

A final object of this invention to be specifically enumerated herein is to provide a batting practice device in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
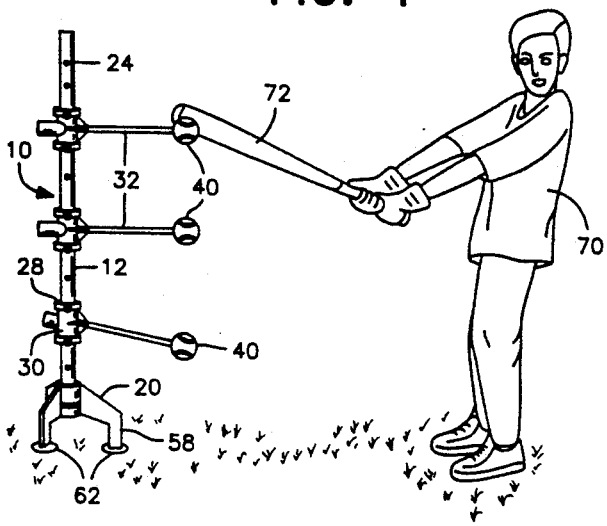
FIG. 1 is a perspective view of the batting practice device with a child supporting a bat in his hands disposed in position to strike either one of the target balls supported from the support arms of the batting practice device projecting toward the child.

Referring now more specifically to the drawings the numeral 10 generally designates the batting practice device of the instant invention. The device 10 includes an upright standard 12 having upper and lower ends 14 and 16 and the lower end 16 is supported from a base 20 adapted to maintain the upright 12 relative to a horizontal surface 22 from which the base 20 is supported.

The upright or standard 12 is tubular and cylindrical in configuration and includes vertically spaced sets of diametrically aligned radial bores 24 with each set of bores 34 comprising adjacent pairs of vertically spaced diametrically registered bores. The vertical spacing between each pair of registered bores 24 is identical to the vertical spacing between adjacent bores of adjacent sets of bores.

Selected sets of bores 24 have retaining pins 26 passed therethrough as well as through diametrically opposite radial bores formed in a pair of corresponding abutment rings 28. A journal sleeve 30 is journaled on the upright 12 between the corresponding set of abutment rings 28 and each journal sleeve 30 supports a horizontal support arm 32 therefrom including a base end 34 supported from the sleeve 30 and a free end 36 which projects generally radially outwardly from the sleeve and is externally threaded as at 38. A resilient target ball 40 is provided for each support arm 32 and includes a threaded radial blind bore 42 therein in which the corresponding free end 36 is removably threaded The base end 34 of each support arm 32 is reinforced relative to the corresponding sleeve 30 through the utilization of integral web plate portions 44 and the sides of the journal sleeves 30 remote from the support arms 32 include outwardly opening and generally radially outwardly projecting large diameter sleeve portions 46 in which weight material 48 is contained such that the support arms 32 may rapidly rotate about the upright 12 in substantially balanced relation.

The pins 26 have pull rings 50 supported therefrom at one end whereby the pins 26 may be removed and the associated abutment rings may be adjusted along the upright 12 before reinsertion of the pins 26. In addition, the ends of the pins 26 remote from the pull rings 50 project beyond the remote sides of the abutment rings 28 and include any suitable structure (not shown) for releasably securing the pins 26 through the abutment rings 28.

The base 20 includes an upwardly opening cylindrical central portion 56 and a plurality of circumferentially disposed of a radially outwardly projecting and downwardly extending ground impaling tines 58 whose lower ends are pointed as at 60, midheight portions of the tines 58 including radially outwardly projecting abutments 62 for butting the surface 22 of the ground into which the lower end portions of the tines 56 are penetrated.

The central portion 56 also includes diametrically opposite bayonet slots 64 formed therein and the lower end 16 of the upright 12 includes diametrically opposite radially outwardly projecting bayonet connection pins 66 downwardly receivable through and releasably lockable within the slots 64.

Figure 2:
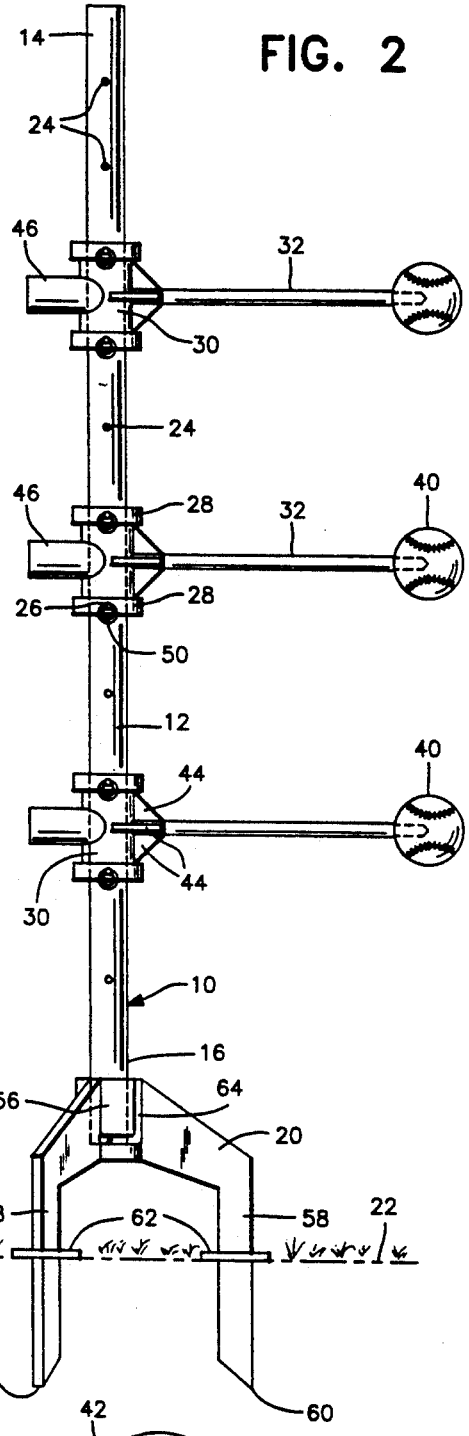
FIG. 2 is an enlarged side elevational view of the batting practice device.
Figure 4:
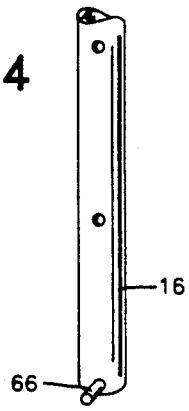
FIG. 4 is a fragmentary perspective view of the lower end of the upright portion of the batting practice device illustrating one of the male pins of the bayonet connection by which the lower end of the upright is removably supported from the base of the batting practice device.

From viewing FIG. 1 of the drawings it may be noted that the support arms 32 may be vertically spaced to allow a child 70 to effect practice swings with a bat 72 at the target member balls 40 which are disposed at different heights to simulate a low ball, a high ball or a midheight ball. Of course, the vertical spacing between the balls 40 may be adjusted as may be better understood from FIG. 2 of the drawings. Furthermore, the overall elevation of the three support arms 32 may be adjusted as desired according to the height of the child 70.

When a child 70 first begins to use the batting practice device 10, the support arms 32 may be adjusted according to the height of the child 70 and the child may make practice swings at the balls 40 in an alternate manner as directed by a coach so that the child 70 may practice quickly determining whether he is to swing at a high ball, a low ball or a midheight ball.

When the desired ball 40 is properly struck by the bat 72, the corresponding support arm 32 will swing about the upright 12 in a substantially balanced manner and when the arm 32 finally comes to a rest it may be repositioned in a manner similar to that shown in FIG. 1.

However, as the child 70 becomes more proficient, a coach coaching the child 70 may have all three arms 32 disposed on the side of the upright 12 remote from the child 70 and the coach may then quickly bat, with his hand, one of the balls in a counterclockwise direction so that the corresponding support arm may swing that ball around the upright 12 and finally into position approaching the child 70 as through it had been pitched by a pitcher. Of course, the child 70, upon seeing which support arm 32 is being swung toward him must then make his swing according to the height of the corresponding ball. Thus, it may be seen that the adjustable height batting practice device of the instant invention may be used effectively to teach beginning children the basics of batting practice.

The foregoing is considered as illustrative only of the principles of the invention. Further, since numerous modifications and changes readily will occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A multiple height batting practice device for children, said device including an upright standard having upper and lower ends, said lower end including base means for supporting said standard in an upright position from a horizontal surface, said standard including a plurality of pairs of vertically spaced apart circumferential, radially outwardly projecting abutment means thereon, a support sleeve journaled on said standard between each pair of abutment means, each of said sleeves including an elongated horizontal arm supported therefrom with a base end of each arm supported from the corresponding sleeve and a free end of each arm projecting generally radially outwardly of the corresponding sleeve, each of said free ends including a target member thereon to be swung at with a bat member, each of said support sleeves including, on the side thereof opposite the side from which the corresponding support arm projects, an outwardly opening sleeve in which weight material is disposed for balancing said sleeve for rotation about said upright in a substantially balanced manner with said weight material at least substantially offsetting the weight of the corresponding support arm and target member.

2. The batting practice device of claim 1 wherein said base includes a plurality of depending ground engaging tines for downwardly penetrating the ground.

3. The batting practice device of claim 2 wherein said tines include upper end outwardly projecting abutment members for abutting engagement with the surface of the ground.

4. The batting practice device of claim 1 wherein said radially outwardly projecting abutment means and the corresponding support sleeves are adjustable vertically along said upright.

5. The batting practice device of claim 4 wherein said abutment means comprise abutment rings extending circumferentially about said upright, said rings and said upright including diametrically opposite radial bores formed therein registerable with each other, and a diametric pin removably secured through each set of registered bores.

6. The batting practice device of claim 6 wherein each pair of diametrically opposite radial bores formed through said upright for supporting a corresponding pair of rings are spaced apart a distance measured longitudinally of said upright equal to the distance between the last mentioned radial bores and the next pair of upright registered radial bores disposed above and below said last mentioned registered bores.

7. The batting practice device of claim 6 wherein said base includes a plurality of ground engaging tines for downwardly penetrating into the ground.

8. The batting practice device of claim 7 wherein said tines include upper end outwardly projecting abutment members for abutting engagement with the surface of the ground.

9. A multiple height batting practice device for children, said device including an upright standard having upper and lower ends, said lower end including base means for supporting said standard in an upright position from a horizontal surface, said standard including a plurality of pairs of vertically spaced apart circumferential, radially outwardly projecting abutment means thereon, a support sleeve journaled on said standard between each pair of abutment means, each of said sleeves including an elongated horizontal arm supported therefrom with a base end of each arm supported from the corresponding sleeve and a free end of each arm projecting generally radially outwardly of the corresponding sleeve, each of said free ends including a target member thereon to be swung at with a bat member, said base defining an upwardly opening centrally disposed cylindrical sleeve portion, said sleeve portion including at least one bayonet slot formed therein, the lower end of said upright including a radially outwardly projecting bayonet pin receivable in said slot.

10. A multiple height batting practice device for children, said device including an upright standard having upper and lower ends, said lower end including base means for supporting said standard in an upright position from a horizontal surface, said standard including a plurality of pairs of vertically spaced apart circumferential, radially outwardly projecting abutment means thereon, a support sleeve journaled on said standard between each pair of abutment means, each of said sleeves including an elongated horizontal arm supported therefrom with a base end of each arm supported from the corresponding sleeve and a free end of each arm projecting generally radially outwardly of the corresponding sleeve, each of said free ends including a target member thereon for striking by a bat member, each pair of diametrically opposite radial bores formed through said upright for supporting a corresponding pair of rings being spaced apart a distance measured longitudinally of said upright equal to the distance between the last mentioned radial bores and the next pair of upright registered radial bores disposed above and below said last mentioned radial bores, said base including a plurality of ground engaging tines for downwardly penetrating into the ground, said tines including upper end outwardly projecting abutment members for abutting engagement with the surface of the ground, said base defining an upwardly opening centrally disposed cylindrical sleeve portion, said sleeve portion including at least one bayonet slot formed therein, the lower end of said upright including at least one radially outwardly projecting bayonet pin receivable in said slot.

* * * * *

UNITED STATES PATENT AND TRADEMARK OFFICE

CERTIFICATE OF CORRECTION

PATENT NO. : 5,303,914

DATED : April 19, 1994

INVENTOR(S) : Dennis W. COOKSEY

Figure 3:
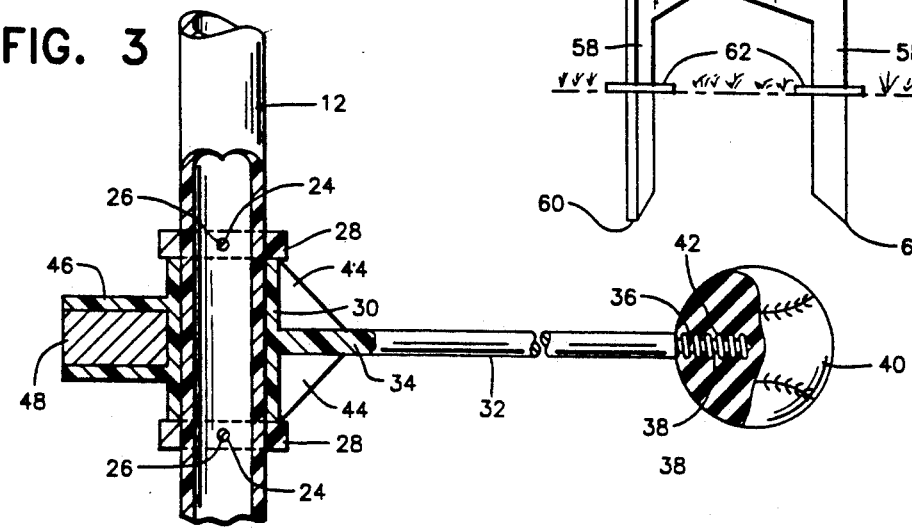
FIG. 3 is a fragmentary further enlarged side elevational view of the batting practice device with portions of the device being broken away and illustrated in vertical section in order to illustrate the manner in which each of the counterbalanced support arms is journaled from the upright and the manner in which the target member is secured to the outer end of the support arm.

It is certified that error appears in the above-identified patent and that said Letters Patent is hereby corrected as shown below:

Drawings:
At the lower right on Figure 3, the numeral "38" without a lead line should be deleted.

Column 2, line 64, cancel "34" and insert --24--.

Column 3, line 39, cancel "56" and insert --58--.

Column 5, line 1, cancel "6" (second occurrence) and insert --1--.

Signed and Sealed this

Twenty-ninth Day of July, 1997

Bruce Lehman

*Attest:*

BRUCE LEHMAN

*Attesting Officer*

*Commissioner of Patents and Trademarks*